United States Patent [19]

Gebelius

[11] Patent Number: 4,648,220

[45] Date of Patent: Mar. 10, 1987

[54] SUPPORTING MEMBER

[76] Inventor: Sven R. Gebelius, Drottningholmsv. 195, Bromma, Sweden, S-16136

[21] Appl. No.: 740,061

[22] PCT Filed: Sep. 29, 1983

[86] PCT No.: PCT/SE83/00342

§ 371 Date: May 28, 1985

§ 102(e) Date: May 28, 1985

[87] PCT Pub. No.: WO85/01535

PCT Pub. Date: Apr. 11, 1985

[51] Int. Cl.[4] ..... E02D 27/00

[52] U.S. Cl. ..... 52/155; 52/738; 52/292; 405/237

[58] Field of Search ..... 52/292, 155, 159, 738, 52/800; 405/244, 237, 238, 720

[56] References Cited

U.S. PATENT DOCUMENTS

| | | | |
|---|---|---|---|
| 1,426,044 | 8/1922 | Clum | 52/155 |
| 1,821,850 | 9/1931 | Riemenschneider | 52/720 |
| 3,855,745 | 12/1974 | Patterson et al. | 52/159 |

FOREIGN PATENT DOCUMENTS

| | | | |
|---|---|---|---|
| 223077 | of 1910 | Fed. Rep. of Germany | 52/155 |
| 649132 | 8/1937 | Fed. Rep. of Germany | 405/237 |
| 2042019 | 9/1980 | United Kingdom | 52/155 |
| 802460 | 2/1981 | U.S.S.R. | 52/292 |

*Primary Examiner*—William F. Pate, III
*Assistant Examiner*—Caroline D. Dennison
*Attorney, Agent, or Firm*—Holman & Stern

[57] ABSTRACT

A support having a corrugated wall and a generally conical shape is insertable into a foundation material such as sand or dirt. During insertion, the lower end flares outwardly until the corrugations are fully expanded, whereupon the tensile strength of the wall forming the tubular body resists further expansion. The greatly increased surface area presented transverse to the direction of insertion, causes a large increase in resistance. The member with its base expanded can then be filled with concrete or other filler material and used as a stable foundation support.

8 Claims, 4 Drawing Figures

SUPPORTING MEMBER

CROSS REFERENCE TO RELATED APPLICATION(S)

This United States application stems from PCT International Application No. PCT/SE83/00342 filed Sept. 29, 1983.

BACKGROUND OF THE INVENTION

The present invention relates to a supporting member, intended to be driven down into soil, clay, sand or any other foundation, and to serve as a load absorbing and supporting member.

For many fields of use, supporting members are required, which can be applied against a foundation lacking required load supporting capability, or with respect to foundations in which a certain movement can be expected in the foundation material. As base reinforcement for house building projects, pile driving methods are normally used today, whereby for instance concrete poles are driven down through a soft ground layer to a supporting ground layer. For construction work below water, cylindrical pipes are also used for certain applications, driven down through an existing soft bottom layer to a lower located solid rock or other firm layer.

With respect to both these methods, the supporting members must normally be driven down to a relatively large depth, which is time and cost consuming. Even with regard to simple construction work, e.g. small craft landing-stages, for which cylindrical pipes often are used to support the fixed portion of the landing-stage, considerable lengths of pipe may be required, resulting in joining operations being necessary, but also in high costs for the pipes utilized. Previously known load supporting members are also characterised in a relatively large weight, and also large longitudinal extension, which results in difficult and expensive transport to the construction site.

SUMMARY OF THE INVENTION

The object of the present invention is to disclose a supporting member, which can be used as replacement for previously known types of members for the above mentioned purposes, and which do not require driving to the same depth as previously known types of members, and also have a considerably reduced weight in relation to previously used members. The member according to the present invention can further easily be modified to suit all types of foundation, and the costs for application, and manufacture of the member, are considerably lower than previously known types. The member according to the present invention has normally a relatively short longitudinal length of extension, and low weight, which facilitates simplified and low cost transports, and storage.

The supporting member according to the present invention is mainly characterised in that it comprises of at least one conical tubular member, having a number of profiled portions extending in longitudinal direction of the member, the larger end portion being arranged to be diametrically expanded, when said larger end portion is driven down, by means of internal pressure application from foundation material entering into the tubular member, thereby forming a relatively large expanded supporting surface in relation to the foundation.

BRIEF DESCRIPTION OF THE DRAWINGS

A number of embodiments of a supporting member according to the present invention are more fully described below with reference to the enclosed drawings, in which.

DETAILED DESCRIPTION OF THE INVENTION

Figure 1:
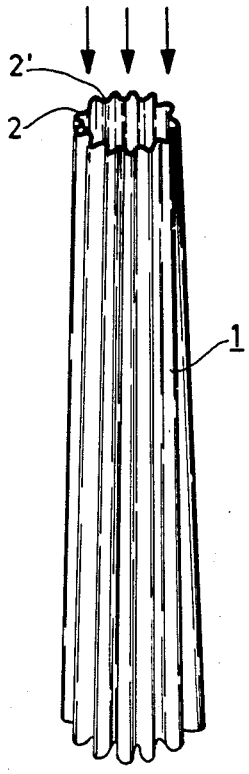
FIG. 1 shows a perspective view of a first embodiment of a supporting member according to the present invention, the direction of application against a foundation being indicated be means of arrows.
Figure 2:
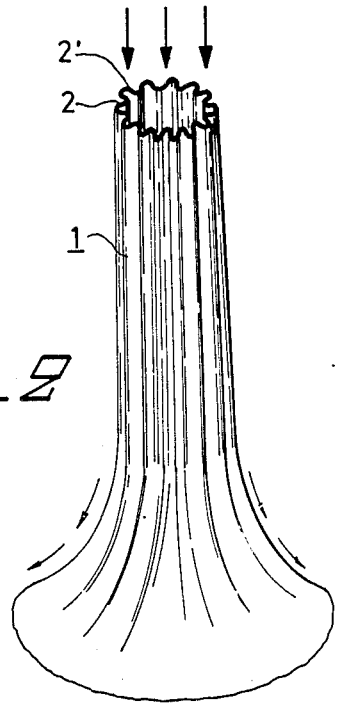
FIG. 2 shows a view corresponding to FIG. 1, when the member has been driven down into a not shown foundation, and expanded with regard to the larger end portion.

With reference to FIG. 1, a frustoconical tubular member is shown, as a complete unit designated 1, and having longitudinally extending corrugations or profiled portions 2, 2'. Said corrugations or profiled portions 2, 2' are advantageously, but not necessary, arranged having successively changed shape or depth in longitudinal direction, in order to cause intended conical shape for the frustoconical tubular member 1. The corrugations or profiled portions 2, 2' also serve a further and primary function, namely to facilitate expansion of the larger end portion of the frustoconical tubular member 1 when same is driven down into a foundation, e.g. sand, gravel, clay, soil or similar. When the frustoconical tubular member 1 is driven down into such a foundation, and with the larger end portion used as a first penetrating end portion, the material of the foundation, obviously enters into the frustoconical tubular member 1. Due to the frustoconical shape of said member 1, the bearing pressure of entering material acting on the internal wall surface of the tubular member 1 is succesively increased, thus causing a diametrical expansion as indicated in FIG. 2. As a result of said expansion, the larger end portion is reshaped into a substantially plate-shaped part extending from the tubular member 1 as a collar, resulting in a large supporting area being achieved in relation to existing foundation at a point located below the surface of said foundation.

In order to further increase said area, and also to reinforce the tubular member 1 with regard to load supporting ability and rigidness, said member 1 may advantageously after completed driving operation with associated expansion be filled from above with suitable material, such as cement, concrete or similar. Alternatively, a member intended to be joined to the supporting member 1 may be inserted down into the latter member 1, existing gap between said members being filled with a suitable joining material.

In order to increase the resistance against expansion of the larger end portion, and also to reinforce the supporting member 1, the embodiment shown in FIGS. 1 and 2 may be further modified, and an example of such a modification is shown in FIG. 3 and FIGS. 4A, 4B and 4C. A number of frustoconical tubular members are used, denominated 1', 1'' and 1''', arranged in successively falling lengths in relation to each other, whereby the inside tubular member 1' extends with its larger end portion out from a surrounding tubular member 1'', being an intermediately located member 1'' in relation to an outside tubular member 1'''. The latter and outside tubular member has a shorter length extension than the intermediately located tubular member 1'', whereby said intermediately located member 1'' thus extends out from the larger end portion of the outside tubular member 1'''. Said three frustoconical and tubular members 1', 1'', 1''' are illustrated individually in FIGS. 4A, 4B and 4C respectively, and joined together and expanded in FIG. 3, and the last mentioned figure also shows the direction of application against a foundation by means of arrows, as well as the method in which the larger end portions are deflected and expanded diametrically by means of the internal bearing force caused by foundation material entering into the members 1', 1'', 1'''.

To arrange a number of frustoconical tubular members 1', 1'', 1''' in the above described fashion also results in reduced risk for formation of cracks in the expanded collar-shaped part, and the load supporting capability of the member 1 is also considerably improved. An applied member 1 can obviously be reinforced in the fashion described with reference to the embodiment disclosed in FIGS. 1 and 2, and also correspondingly joined to a member extending in direction from the smaller end portion of the member 1.

It should also be mentioned, that a supporting member 1 according to the present invention, before application against a foundation, obviously may advantageously be joined to a second member, extending from the smaller end portion of said member 1, whereby necessary driving force can be applied against such a member, attached to the frustoconical tubular member 1.

Figure 3:
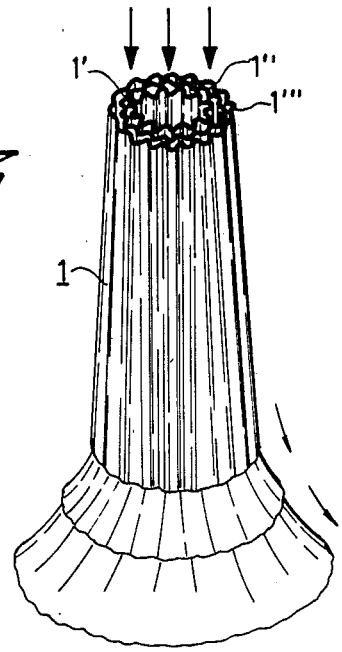
FIG. 3 shows a perspective view of a second embodiment of a member according to the present invention, driven down into a not shown foundation with a direction of application as indicated by arrows, and expanded with regard to the larger end portion.
Figure 4:
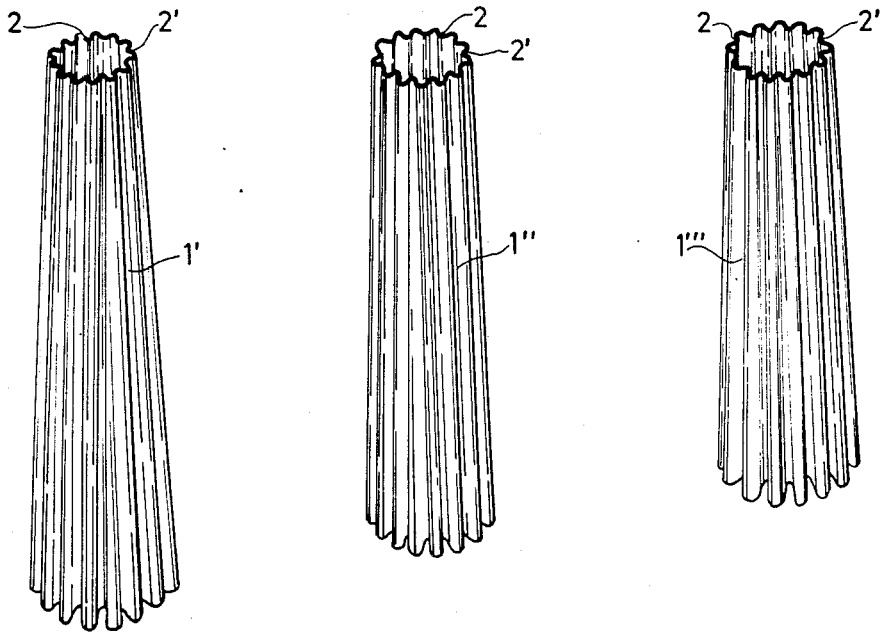
FIGS. 4A, 4B and 4C show perspective views of the parts included in the member shown in FIG. 3, said parts being shown before the expansion caused when driven down into a foundation.

In view of the fact that it may be desirable to change the resistance against expansion of the tubular member 1 for certain applications, it should also be mentioned, that the frustoconical tubular members 1', 1'', 1''', shown in FIGS. 4A, 4B and 4C respectively, may also be arranged in a reversed relationship to what is shown in FIG. 3, i.e. with the shortest member 1''' as an inside member and with the longest member 1' used as an outside member, The number of members used can also be varied freely for every application, i.e. from a single member, as disclosed with reference to FIGS. 1 and 2, to any desired number of members 1', 1'', 1''', located in an embracing relationship to each other. Furthermore, it has also been stated, that a supporting member 1, formed by means of a number of each other embracing members 1', 1'', 1''', should be arranged with the embracing members having in relation to each other falling lengths, but for certain applications, one or a number of such members 1', 1'', 1''' may be arranged with the edge portions of the larger end portions located in an adjacent position in relation to each other, i.e. having similar lengths.

A frustoconical supporting member according to the present invention thus results in substantial advantages in relation to previously utilized types of supporting members for corresponding purposes, and due to the fact that the larger end portion of the tubular member 1 is expanded into a surrounding collar-shaped part when driven down into a foundation, a large supporting surface is achieved, which reduces necessary penetration depth. Furthermore, there are large possibilities to vary the penetration depth as desired and on basis of the foundation characteristics. Such variations are easily accomplished by varying the wall thickness of the tubular member 1, and by varying the number of tubular members 1', 1'', 1''' included in the supporting tubular member 1, as well as by varying the conicity of the supporting tubular member 1. Furthermore, the area of the expanded collar-shaped part can also be varied freely, by changes in the longitudinally extending corrugations or profiled portions 2, 2' with regard to cross-section and depth. A frustoconical tubular member 1 may thus, with regard to the diameter of a circle enclosing the larger end portion in non-expanded condition, after expansion show a diameter that is increased several times in relation to said first diameter.

The frustoconical tubular member 1 according to the present invention is also well suited for construction works above as well as below water, and can easily be modified to result in complete expansion at intended depth in relation to the penetration surface of the foundation, as well as with regard to the area of the expanded collar-shaped supporting part.

The embodiments shown and described are only intended to serve as basic examples of embodiments within the scope of the inventive thought, and may thus be varied in a number of ways within the scope of the following claims.

I claim:

1. A supporting member for penetration into a foundation by subjection to a substantially linear driving force, comprising:

a plurality of frustoconical tubular bodies, each one of said bodies having an upper end and a lower end; each of said frustoconical tubular bodies having a central axis and a wall; each said wall being initially corrugated at least in the vicinity of said lower end which is adapted to expand outwardly at said lower end during insertion into a foundation; each said lower end having a bottom edge; each said bottom edge being initially corrugated;

each said frustoconical tubular body having an undeformed condition and a deformed condition, wherein said deformed condition is caused by forcible insertion of said lower end of said frustoconical tubular body into a foundation;

in said deformed condition, said lower end being expanded outwardly so as to present a substantially larger projected area transverse to said axis than in said undeformed condition and said bottom edge having substantially no corrugations; whereby the driving force is resisted at least partly due to tensile strength in said wall adjacent said bottom edge;

said plurality of frustoconical tubular bodies including at least three said frustoconical tubular bodies, two of said at least three bodies being disposed generally concentrically about a first one of said at least three bodies;

whereby said frustoconical tubular body is deformed from said undeformed condition during penetration of said lower end into the foundation, with resistance to the driving force increasing sharply when said deformed condition is reached.

2. A supporting member according to claim 1, wherein said additional frustoconically tubular bodies are disposed such that larger edge portions thereof are located in an adjacent position to each other.

3. A supporting member according to claim 1, wherein said additional frustoconically tubular bodies are disposed such that larger edge portions thereof are located in a staggered relationship.

4. A supporting member according to claim 1, wherein an expandable supporting surface of said wall can be modified by varying selectively the number, depth and cross-section of the corrugations.

5. A supporting member according to claim 1, wherein resistance against expansion of said frustoconically tubular member can be modified by varying selectively the conicity of the member, the wall thickness, and the material of said wall.

6. A supporting member according to claim 1, wherein at least one said tubular surrounds a filling and reinforcing material within an area at a distance from said lower end, and extending in direction towards said upper end.

7. A supporting member according to claim 1, wherein said frustoconical tubular body is disposed surrounding a second one of said at least three bodies, extending into said first frustoconically tubular body in direction from said upper end, and terminated at a distance from said lower end.

8. A supporting member according claim 7, wherein said second member is attached to said conically tubular body such that it can be used for force application when driving said conically tubular body down into a foundation.

* * * * *